US007891406B2

(12) United States Patent
Benedetti et al.

(10) Patent No.: US 7,891,406 B2
(45) Date of Patent: Feb. 22, 2011

(54) INGOT MOLD FOR CASTING SLABS

(75) Inventors: Gianpietro Benedetti, Tricesimo (IT); Nuredin Kapaj, Udine (IT); Alfredo Poloni, Fogliano Redipuglia (IT)

(73) Assignee: Danieli & C. Officine Meccaniche S.p.A. (IT)

( * ) Notice: Subject to any disclaimer, the term of this patent is extended or adjusted under 35 U.S.C. 154(b) by 267 days.

(21) Appl. No.: 12/067,676

(22) PCT Filed: Sep. 22, 2006

(86) PCT No.: PCT/EP2006/066616

§ 371 (c)(1),
(2), (4) Date: Mar. 21, 2008

(87) PCT Pub. No.: WO2007/039484

PCT Pub. Date: Apr. 12, 2007

(65) Prior Publication Data

US 2008/0271872 A1 Nov. 6, 2008

(30) Foreign Application Priority Data

Sep. 22, 2005 (IT) ..... MI2005A1765

(51) Int. Cl.
*B22D 11/04* (2006.01)

(52) U.S. Cl. ..... 164/418

(58) Field of Classification Search ..... 164/418, 164/459

See application file for complete search history.

(56) References Cited

U.S. PATENT DOCUMENTS

| | | | | |
|---|---|---|---|---|
| 5,460,220 | A * | 10/1995 | Coassin | 164/483 |
| 6,390,177 | B1 * | 5/2002 | Arvedi et al. | 164/418 |
| 6,585,029 | B1 * | 7/2003 | Flick et al. | 164/418 |

FOREIGN PATENT DOCUMENTS

| | | |
|---|---|---|
| DE | 3907351 | 9/1990 |
| EP | 0909597 | 4/1999 |

* cited by examiner

*Primary Examiner*—Kevin P Kerns
(74) *Attorney, Agent, or Firm*—Gifford, Krass, Sprinkle, Anderson & Citkowski, P.C.

(57) ABSTRACT

Ingot mold for casting ultra thin slabs to be used, for instance, in a manufacturing plant for the manufacture of metal strips, having two wide concave walls (11) in the center and two flat portions (12) parallel to the plane of symmetry X in the end zones connected by two convex connecting zones (13) wherein the ratio between the lengths d/l is between 10 and 60% and the ratio h/f is between 10% and 60%.

4 Claims, 2 Drawing Sheets

INGOT MOLD FOR CASTING SLABS

CROSS REFERENCE TO RELATED APPLICATIONS

This application is the U.S. national phase of PCT/EP2006/066616 filed Sep. 22, 2006, which claims priority of Italian Patent Application MI2005A001765 filed Sep. 22, 2005.

SCOPE OF INVENTION

The present invention relates to an ingot mold for casting ultra thin slabs to be used, for instance, in a manufacturing plant for the manufacture of metal strips.

STATE OF THE ART

Numerous types of ingot molds used for casting metal strips, in particular steel, are known in the state of the art. These ingot molds can produce a slab which is subjected to a number of thickness reductions, sometimes associated with surface treatments and machining, depending on the various processes used.

Since the thickness of the slab coming out of the ingot mold is considerable, in comparison to the final thickness to be achieved at the end of the production line, numerous rolling cages are required. Since the passage through every cage involves cooling down the strip, after the passage through some rolling cages, an induction furnace or heating furnace for heating the strip is required for bringing its temperature back to the value necessary for rolling the material properly.

Yet, by doing so, the metal strip machinery will be particularly long because the slabs produced by the ingot molds, of the known type, also called crystallizers, have considerable thicknesses when coming out of the ingot mold, hence they will require numerous intermediate devices which will increase the total length of the machinery to a great extent.

Great efforts have been made to achieve ingot molds able to produce thinner slabs so as to use, along the production line of the strip, less rolling cages to reduce the thickness, thus with the advantage of reducing the total length of the line and to reduce the energy costs for producing the strip.

Currently, with strip manufacturing machinery of the known type, the minimum producible thickness value of a slab coming out of the ingot mold, when using very performing devices, is between 50 and 60 mm. As a result, lower thickness values involve a series of problems which are hardly possible to solve; the main problems are described as follows:

- there is insufficient space for the submerged discharge device, thus its small distance from the wide plates of the crystallizer produces solidification bridges; furthermore, it is necessary to reduce the thickness of refractory material of the discharge device, hence negatively affecting its duration;
- there is too small a surface at the meniscus to effectively melt the lubrication powders, hence resulting in evident critical conditions, especially at high casting speed;
- it is difficult to achieve a slab coming out of the ingot mold which still has an adequate length of the liquid core and be able to carry out a soft-reduction on the slab, which is necessary to improve its internal quality;
- the fluid mechanics inside the crystallizer is not optimal inasmuch as a reduced volume of molten steel, resulting from the reduced thickness, does not allow good turbulence damping which can cause an unstable meniscus, hence with unwanted incorporation of the lubrication powders, which could also cause remelting phenomena of the solidified skin which will negatively affect the quality of the end product achieved.

Document U.S. Pat. No. 5,460,220 describes, for example, an ingot mold for the production of cross-sectional slabs used particularly for a "soft reduction" treatment which helps improve the structural qualities of the strip. Such ingot mold, however, is able to produce slabs with a thickness that still requires considerably large machinery for the production line.

Furthermore the configuration and the dimensions of the basin of this ingot mold are not sufficient to prevent the molten steel jets of the discharge device from causing an unwanted remelting phenomenon of the skin formed on the surface of the basin thereof, resulting from the high turbulence which is produced in the ingot mold feeding zone.

Finally, with this ingot mold, it is not possible to operate at adequately high casting speeds, hence it does not allow the possibility to receive high rates of molten steel from the discharge device without producing flaws.

Thus, it is necessary to achieve an ingot mold to cast slabs to overcome the foregoing drawbacks.

SUMMARY OF THE INVENTION

One main purpose of the present invention is to achieve an ingot mold for casting ultra thin slabs to be used, for instance, in a manufacturing plant for the manufacture of metal strips, in particular steel strips. Another purpose of the ingot mold, according to the invention, is to produce strips with thin thicknesses, about 20 mm, at high casting speeds and able to reach 16 m/min, thereby achieving a slab with good internal quality.

Advantageously, a more accentuated convex shape of the parts of the basin or casting chamber of the ingot mold, according to the invention, ensures enough space to prevent the molten steel jets of the discharge device from causing an unwanted remelting phenomenon of the skin formed around its internal surface, especially starting at a certain distance from the discharge device, which is the biggest area of the jet section. As a result, it is possible to get a better discharge flow in the feeding zone of the ingot mold where the discharge device of molten steel is placed, in addition to less turbulence.

Therefore, the present invention intends to solve the above-mentioned problems by achieving an ingot mold for casting ultra thin (20-50 mm) steel slabs, with casting speed between 6 and 16 m/min, thus defining a longitudinal plane of symmetry and a cross-sectional plane of symmetry, reciprocally orthogonal, comprising a passing cavity with an entrance section and an exit section of the steel, the cavity surface consisting of two first walls—arranged reciprocally facing two opposite sides of the longitudinal plane of symmetry and two second narrow, flat and rectangular walls parallel to the cross-sectional plane of symmetry, wherein the first and second walls form four longitudinal corners in the reciprocal connecting areas and where the first walls have a concave central area, with concavity facing the longitudinal plane of symmetry, straight portions of the wall relative to its ends and intermediate convex connecting portions, with convexity facing the longitudinal plane of symmetry, wherein the connecting portions and the concave central area determine inflection points in the reciprocal connecting points and in which the straight portions of the wall and the connecting portions determine connecting points in the reciprocal junction points wherein the ratio between the length d/l is between 10 and 60% and the ratio h/f is between 10% and 60% wherein "d" is the length of the connecting portion measured in projection view on the longitudinal plane of symmetry, length "l" is the distance between the two symmetrical connecting points relative to the cross-sectional plane of symmetry, measured in projection view on the plane of symmetry (X), "h": is the distance between the connecting point P and the inflection point P' measured in projection view on the cross-sectional plane of symmetry Y;

"f" is the distance between point P' and the tangent to the concave area in the maximum point of concavity measured in projection view on the plane of symmetry Y.

According to the invention, by using the ingot mold it is possible to cast a slab with a thickness much smaller than the thickness that can be achieved with known ingot molds, between 20-50 mm, yet helping maintain a certain length of liquid core downstream of the exit section of the ingot mold, and wherein the core remains liquid even in the zones nearest the furthermost side parts. Hence, when the slab is subjected to the liquid core pre-rolling, it will be possible to obtain a refinement of the internal structure by reducing the central porosity as well as the segregation.

Thus the possibility to cast ultra thin slabs of the above-mentioned dimensions makes it possible to achieve metal strip machinery with a reduced height and length compared to the machinery known in the art.

Moreover, it is necessary to point out an additional advantage: the strip obtained at the end of the passage throughout the whole hot-rolling and casting line is already at its final thickness and ready to be used, without the need to carry out an additional treatment in a cold-rolling line.

The dependent claims describe preferred embodiments of the invention.

BRIEF DESCRIPTION OF THE FIGURES

Further features and advantages of the invention will become apparent by means of the detailed description of preferred embodiments, given by way of not limitative examples of an ingot mold, illustrated with the aid of the following figures wherein.

DETAILED DESCRIPTION OF PREFERRED EMBODIMENTS OF THE INVENTION

Figure 1:
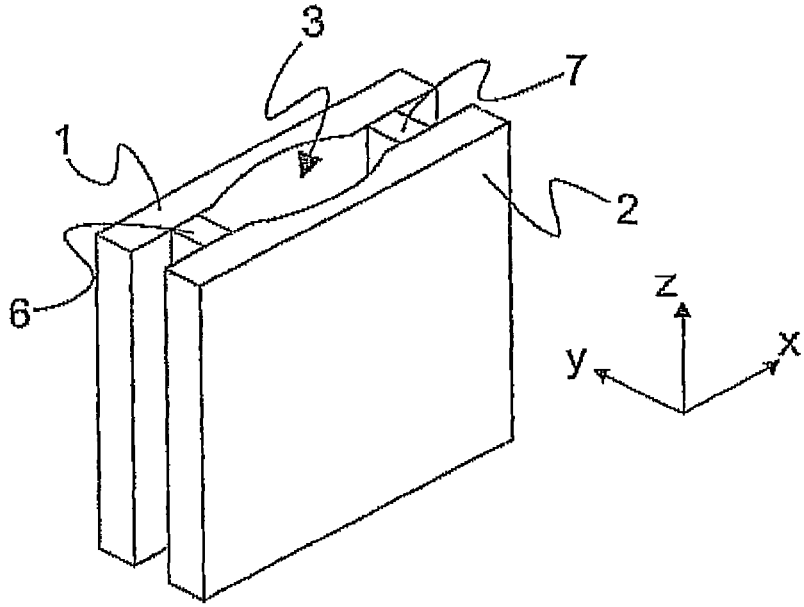
FIG. 1 shows a three-dimensional view of the ingot mold of the invention.

With reference to FIG. 1, where an orthogonal reference axis system is defined, x, y, z, there is a representation of an ingot mold—with a longitudinal plane of symmetry X parallel to the axes of reference x-z, and a cross-sectional plane of symmetry Y parallel to the reference axes y-z—comprising two wide plates 1, 2 which, when coupled together with two interposing elements or narrow walls 6, 7, determine a through cavity or basin or casting chamber 3.

The surface of said cavity is determined by two wide walls 4, 5, reciprocally arranged and facing out on opposite sides relative to the plane of symmetry x-z, and by narrow walls 6, 7, arranged at a right angle relative to the plane of symmetry Y. The walls 4, 5, 6, 7 form four longitudinal corners in their connecting zones.

The wide walls 4, 5 of the plates 1, 2 have a double curvature. One is concave whereas the other is convex and faces the longitudinal plane of symmetry X.

Figure 4:
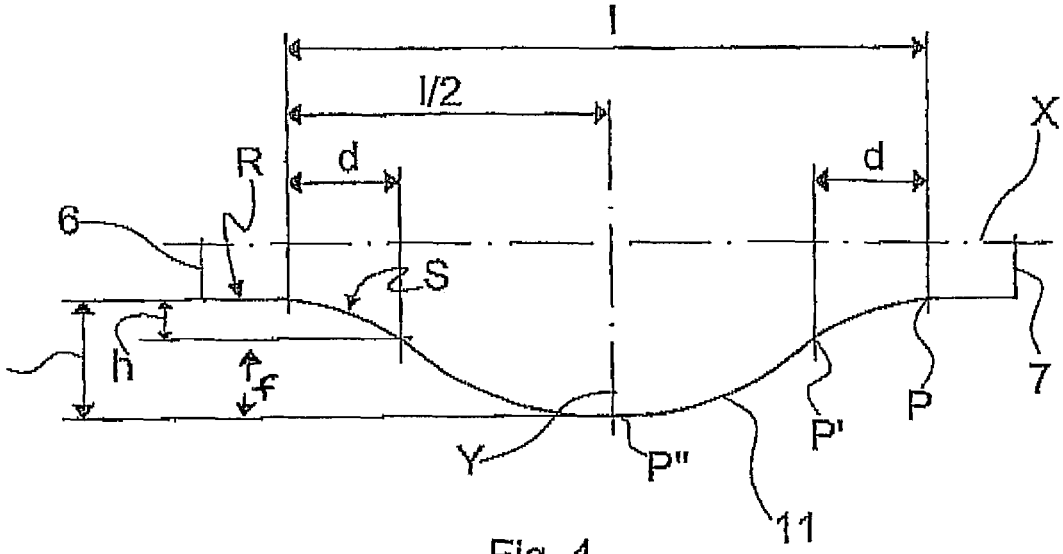
FIG. 4 shows a semi-section view along a plane parallel to the reference axes x-y of the ingot mold in FIG. 1.

Advantageously, considering a section which is transversal and perpendicular to plane X as described in FIG. 4, each of the wide walls 4, 5 comprises:

a concave central area 11, with concavity facing the longitudinal plane of symmetry X, in the shape of a semi-circular arc, two flat lateral zones 12, parallel to the plane of symmetry X, each of which located near one end of the concave central area 11, two connecting zones 13, with a convex surface, between the semi-circular arc of the central zone 11 and the lateral zones 12, with convexity facing the plane of symmetry X.

With reference to the left side of the semi-section view, the following references are given in FIG. 4:

P is the intersection point of the rectilinear portion R of the flat zone of the walls with convex connecting portion S;

P' is the point in which the concavity of the wide plate 2, also called inflection point, changes;

point P" is the intersection point of the concave area 11 with the cross-sectional plane of symmetry Y parallel to the reference axes y and z.

At this point, the following values are given:

length "d": is the distance between point P and point P' measured in projection view on the plane of symmetry X parallel to the reference axes x and z;

length "l": is the distance between point P and its symmetrical point relative to plane Y measured in projection view on the plane of symmetry X; "l/2" is thus the distance between point P and point P'—maximum point of concavity—measured in projection view on the plane of symmetry X;

height "h": is the distance between point P and point P' measured in projection view on the plane of symmetry Y;

height "f": is the distance between point P' and point P" measured in projection view on the plane of symmetry Y; such value is also called camber or lateral semiextension.

According to the invention, the ingot mold advantageously has the following values at the entrance section:

l is between 750 and 1500 mm f is between 15 and 100 mm

Furthermore, in the entrance section, again, ratio d/l and ratio h/f are between 10% and 60%.

Figure 2A:
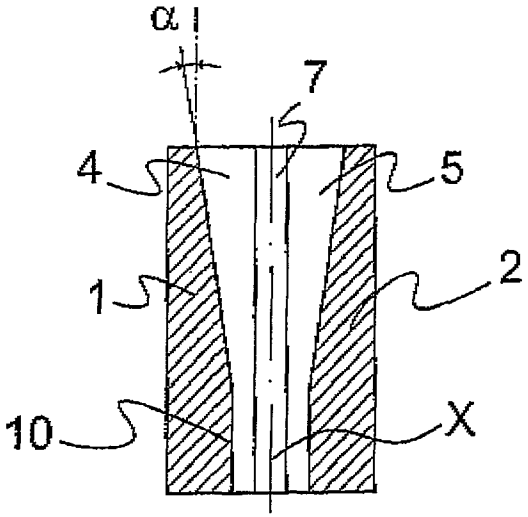
FIG. 2*a* shows a section along plane y-z of the ingot mold of FIG. 1.
Figure 2B:
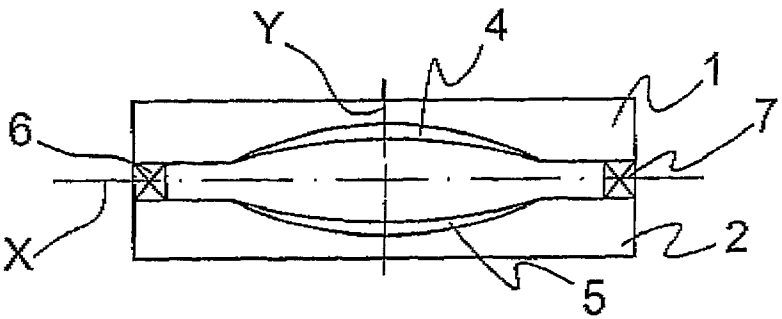
FIG. 2*b* shows a plane view of the ingot mold of FIG. 1.

A first advantageous variation of the ingot mold, according to the present invention, includes a casting chamber 3 with an entrance section of the steel larger than an exit section. In particular, the radius of curvature of the concave area 11, when in the shape of a semi-circular arc, has a linearly increasing value—on the cross-sectional plane—between the entrance section and an intermediate section, which corresponds to the terminal section of the casting chamber before the exit section of the steel; instead, the radius of curvature of the connecting zones S has a linearly decreasing value between the entrance section and said intermediate section. In this case, such cavity or casting chamber 3 will longitudinally pass through generating lines converging towards the exit as far as the intermediate section. As a result, in the section described in FIG. 2*a*, there is a decrease in width with a conical trend. In this case, the value of the camber f in the entrance section of the ingot mold has a maximum value and a minimum value at the exit section of the basin. Advantageously, the ingot mold of this invention includes an inclination of the walls of said chamber, converging towards said intermediate section, determined by an angle $\alpha$(from 0°-7°) wherein said angle $\alpha$ is measured as an inclination relative to plane X, and in projection view, on the plane of symmetry Y.

This particular configuration of the casting chamber also allows the molten steel to skim the flat-faced side zones 12 as far as the corners, thus preventing the complete solidification of the slab in such zones although the distance between said faces is shorter than that known in the art.

The bottom end of the ingot mold includes a final portion 10 with a parallel-generating line, the length of which is predetermined and is structurally identical to said intermediate section to allow the removal of the shaped head of the dummy bar in order to start the continuous casting process.

Moreover, the smaller inclination angle of the wide walls 4, 5 of the casting chamber determined by the angle alpha ($\alpha$) prevents the unwanted remelting phenomenon of the formed skin inasmuch as the molten steel introduced in the chamber by the discharge device does not cause turbulences in the feeding zones of the ingot mold near the walls, thereby ensuring an optimal flow of the discharged steel.

The narrow walls 6, 7, preferably flat and rectangular, in a preferred variation of the invention, are advantageously moveable and capable of moving toward or away from each other, thereby allowing the width adjustment of the slab. Additionally, they can change their tapering shape. More precisely, they can be tilted towards the exit section of the steel so as to reduce the width of the exit section, thus avoiding shrinkage problems during the solidification in the ingot mold.

It is possible to cast ultra thin slabs at high casting speeds through the ingot mold or crystallizer of the invention. all this is performed without creating excessive deformations, hence cracks, on the slab skin which moves along the walls of the crystallizer.

Of particular relevance is the fact that the internal structure of such ingot mold ensures a suitable volume of molten steel, thus when the slab comes out, there will still be a certain length of the liquid core. This particular shape maintains the liquid core even when very close to the furthermost sides of the slab, thereby making a subsequent liquid core pre-rolling possible, the so-called "soft reduction", for the cast slab. Advantageously, the presence of molten steel in the side zones,—hence the fact that in such limited zones the complete solidification has not occurred—will prevent unwanted cracks and ensure an effective melting of the lubrication powders.

Figure 3A:
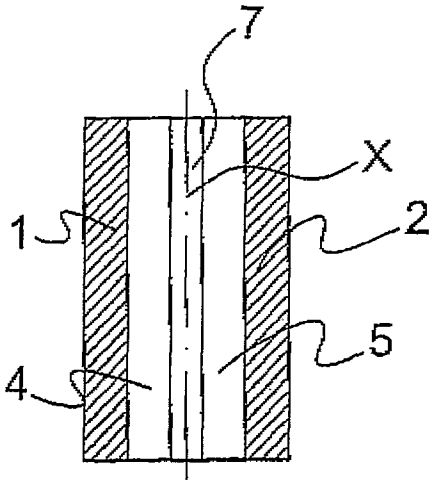
FIG. 3*a* shows a section along plane y-z of another embodiment of the ingot mold of the invention.
Figure 3B:
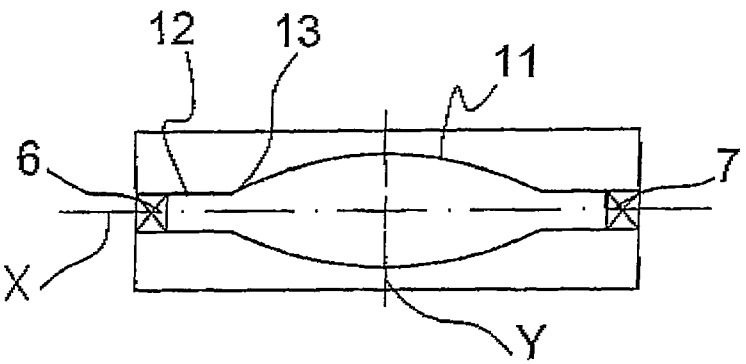
FIG. 3*b* shows a plane view of the embodiment of FIG. 3*a;*

Conversely, a second variation of the ingot mold according to the invention includes entrance and exit sections of equal dimensions, as described in the section in FIG. 3*a*. In this case, the radii of curvature maintain the same value in each point of the longitudinal extension of the casting chamber between the entrance section and the exit section of the steel. In this variation, the aforesaid intermediate section coincides with the exit section of the steel.

The casting of very thin slabs, through the ingot mold of the invention, allows for the possibility to create a starting product, i.e. the slab thereof, with a thickness which is already very close to that of the finished product, namely the strip. Advantageously, the thickness of these thin slabs, when exiting, is between 20 and 50 mm and their casting speed is between 6 and 16 m/min.

The typical convex shape of the slab, in other words the central swelling at the exit of the ingot mold, is cancelled, that is flattened, through the use of rolls placed at the foot of the ingot mold and appropriately shaped, thus performing the liquid core pre-rolling.

This allows for a considerable reduction of the number of machines used in the system/process, which means saving possibilities in terms of first investment and energy.

The invention claimed is:

1. Ingot mold for casting ultra thin (20-50 mm) steel slabs, with casting speed between 6 and 16 m/min, thus defining a longitudinal plane of symmetry (X) and a cross-sectional plane of symmetry (Y), reciprocally orthogonal, comprising a through cavity with an entrance section and an exit section of the steel slab, the cavity surface consisting of two first walls arranged reciprocally facing two opposite sides of the longitudinal plane of symmetry (X) and two second narrow, flat, rectangular walls located parallel to the cross-sectional plane of symmetry (Y), wherein the first and second walls form four longitudinal corners, wherein the first walls have a concave central zone, with concavity facing the longitudinal plane of symmetry, portions of wall rectilinear to its ends and intermediate convex connecting portions, with convexity facing the longitudinal plane of symmetry (X), in which the connecting portions(S) and the concave central zone determine inflection points (P') and where the straight portions of wall (R) as well as the connecting portions (S) determine connecting points (P)

wherein a ratio between a length (d)/(l) is between 10 and 60% and a ratio (h)/(f) is between 10% and 60% wherein (d) is a length of the connecting portion measured in projection view on the longitudinal plane of symmetry (X), length (l) is a distance between two symmetrical connecting points relative to the cross-sectional plane of symmetry (Y), measured in projection view on the plane of symmetry (X), (h) is a distance between the connecting point P and the inflection point P' measured in projection view on the cross-sectional plane of symmetry Y;

(f) is a distance between point P' and the tangent to the concave zone in the maximum point of concavity (P") measured in projection view on the plane of symmetry Y and wherein a variation of the radii of curvature in the concave zone results in an inclination of the first walls relative to the longitudinal plane of symmetry (X), of from 0 to 7 degrees and wherein (l) has a value between 750 and 1500 mm and (f) is between 15 and 100 mm at the entrance section.

2. Ingot mold according to claim 1 wherein the concave zone within its sections and on planes perpendicular to the longitudinal and cross-sectional planes of symmetry is in the shape of a semi-circular arc with radii of curvature having a linearly increasing value between the entrance section and a predetermined intermediate section located before the exit section of the steel slab.

3. Ingot mold according to claim 1 wherein the radii of curvature of the concave central zone have the same value in each point of the longitudinal extension between the entrance section and the exit section.

4. Ingot mold according to claim 1 wherein the second walls can be tilted and reciprocally moved toward or away from each other at the exit section.

* * * * *